US006684887B2

(12) United States Patent
Alexander

(10) Patent No.: US 6,684,887 B2
(45) Date of Patent: Feb. 3, 2004

(54) HAIR SEPARATOR AND FLUID APPLICATOR APPARATUS WITH IMPROVED FLUID RETENTION

(76) Inventor: Larry Rush Alexander, 2306 Central St., Evanston, IL (US) 60201

( * ) Notice: Subject to any disclaimer, the term of this patent is extended or adjusted under 35 U.S.C. 154(b) by 0 days.

(21) Appl. No.: 10/090,434

(22) Filed: Mar. 4, 2002

(65) Prior Publication Data

US 2003/0209251 A1 Nov. 13, 2003

Related U.S. Application Data

(63) Continuation-in-part of application No. 09/952,542, filed on Sep. 14, 2001.

(51) Int. Cl.[7] ..... A45D 24/22

(52) U.S. Cl. ..... 132/112; 132/150; 132/160; 132/124; 401/261; 15/104.94; 15/143.1

(58) Field of Search ..... 132/207, 212, 132/219, 112, 124, 125, 148, 150, 160, 265, 268, 270, 321, 901, 113, 114, 116; 401/16, 25, 37, 261; 15/104.94, 160, 143.1, 236.07, 236.08; D4/117, 118, 121, 136, 199; D28/20, 25, 31, 34, 91.2

(56) References Cited

U.S. PATENT DOCUMENTS

| | | | | | |
|---|---|---|---|---|---|
| 1,708,346 | A | * | 4/1929 | Worrell et al. | 81/15.2 |
| 1,819,433 | A | * | 8/1931 | Miller | 132/139 |
| 2,028,588 | A | | 1/1936 | Carson | 132/12 |
| 2,029,835 | A | * | 2/1936 | Reichle | 401/266 |
| 2,249,267 | A | * | 7/1941 | Berry | 132/124 |
| 2,264,346 | A | * | 12/1941 | Tupper | 132/125 |
| 2,270,528 | A | * | 1/1942 | Kirschenbaum | 132/125 |
| 2,833,293 | A | * | 5/1958 | Parker | 132/112 |
| 3,896,823 | A | * | 7/1975 | Spatz | 132/218 |
| 5,042,512 | A | * | 8/1991 | Knight | 132/212 |
| 5,123,431 | A | * | 6/1992 | Wilson | 132/320 |
| 5,188,132 | A | * | 2/1993 | Barkus | 132/219 |
| 5,231,999 | A | * | 8/1993 | Schroettner | 132/137 |
| 5,307,825 | A | * | 5/1994 | Smith | 132/200 |
| 5,311,887 | A | * | 5/1994 | Ramsey | 132/114 |
| 5,433,225 | A | * | 7/1995 | Liggett et al. | 132/208 |
| 5,437,293 | A | | 8/1995 | Colon et al. | 132/120 |
| D370,304 | S | * | 5/1996 | Schach | D28/10 |
| 5,626,153 | A | * | 5/1997 | Petrarca | 132/126 |
| 5,704,388 | A | * | 1/1998 | Freeman | 132/329 |
| 5,887,600 | A | * | 3/1999 | Wilk | 132/262 |
| 5,947,130 | A | * | 9/1999 | Musum | 132/125 |
| 6,026,824 | A | * | 2/2000 | Gueret | 132/218 |
| 6,382,216 | B1 | * | 5/2002 | Clark | 132/148 |
| 6,453,909 | B1 | * | 9/2002 | De Laforcade | 132/208 |

* cited by examiner

*Primary Examiner*—Eduardo C. Robert
*Assistant Examiner*—David Comstock
(74) *Attorney, Agent, or Firm*—McAndrews Held & Malloy, Ltd.

(57) ABSTRACT

A hair separator and fluid applicator that includes a central handle portion, a parting portion disposed adjacent the central handle portion, and an applying portion disposed adjacent the central handle portion opposite the parting portion. The parting portion includes a proximal end and a distal end, the distal end being disposed opposite the central handle portion and generally narrowing from the proximal end to the distal end. The parting portion also may include a generally concave face. The applying portion includes a blade. The blade includes dimples or holes designed to increase the ability of less-viscous fluids or cremes to remain adhered to the surface of the blade. The applying portion may also include teeth disposed along a distal portion for assisting in the application and directional smoothing of the hair during use. The channels between the teeth may vary in shape, including (for example) being half-circular, ovular or rectangular in shape.

12 Claims, 8 Drawing Sheets

HAIR SEPARATOR AND FLUID APPLICATOR APPARATUS WITH IMPROVED FLUID RETENTION

CROSS REFERENCE TO RELATED APPLICATIONS

This application is a continuation-in-part of application Ser. No. 09/952,542, filed Sep. 14, 2001.

BACKGROUND OF THE INVENTION

The invention relates to hair application of various substances such as relaxer, bleach, dye, gel, conditioner and the like. In particular, the invention relates to applying substances to the hair and manipulating the hair once the substance(s) is(are) applied.

In the field of application devices, the tip of a rat-tail comb (i.e., the tip opposite the brush or comb) is currently used to separate sections of hair. The spine part of the comb (i.e., the part which teeth of the comb rest upon, the spine of a brush (i.e., where the bristles of the brush are attached to the brush), the bristles of the brush, or the back or a comb (the spine sections) are currently used to apply relaxer to the hair. In a current use, the handle of the rat-tail comb is narrow as it extends from the bristle portion of the brush. The tip of this handle is currently used to separate a section of hair for manipulation. The brush end, or comb end (opposite the rat-tail end) of the brush's spine adjacent the bristles or comb is then dipped into a container of relaxer. Once the relaxer is on the rear of the comb spine or the brush bristles, the relaxer is applied to the hair, beginning with the hair at or near the scalp and ending at the last part of the section of hair that has not been relaxed (or straightened). In the event the hair has not previously been relaxed or straightened, the relaxer would be applied to the entire hair.

Applying relaxer with either a standard rat-tail comb or brush has several drawbacks. First, the back of the comb spine is generally narrow and/or the brush bristles easily become unstable and flimsy. This limits the user in both: applying fluid to and straightening the hair, thereby limiting the user in manipulating wide sections of the hair that are to become chemically processed in a controlled manner. The user must push the rat tail end (i.e., tip) through the hair several times and continue to apply chemical relaxer creme. This occurs because the chemical usually is absorbed into the hair shafts and disappears, without leaving an adequate amount of viscous fluid matter on the hair. An adequate amount of viscous fluid is desired in order to weigh down the hair sufficiently while the chemical hair softening process takes place. Second, the surface of the spine is generally flat or angled and cannot be efficiently used to press hair against the curved human scalp. Third, the comb generally cannot be efficiently used to apply relaxer to the hair, as: 1) its rat tail comb or brush length requires it to be placed into a reservoir at an angle (thus not allowing amounts of fluids or cremes to be extracted from a horizontal position), and/or 2) its surface does not permit it to be pressed against the reservoir to remove excess fluid or creme, in order to apply an even (i.e., uninterrupted) horizontal line amount of fluid or creme to the hair. Fourth, due to the spaced-apart bristles on current brushes, the application of fluid to the hair with a brush leaves voids (i.e., spaces) where the fluid is not applied.

BRIEF SUMMARY OF THE INVENTION

A hair separator and fluid applicator is provided that includes a central handle portion, a parting portion disposed adjacent the central handle portion, and an applying portion disposed adjacent the central handle portion opposite the parting portion. The parting portion includes a proximal end and a distal end, the distal end being disposed opposite the central handle portion and generally narrowing from the proximal end to the distal end. The parting portion also includes a generally concave face.

The hair separator and fluid applicator may optionally include a ribbed ringlet comb disposed about the handle portion, the ringlet comb being displaceable along a length of the handle portion. The handle portion may optionally be disposed along a generally longitudinally extending axis, with the applying portion extending from the handle portion along a generally longitudinally extending axis. The handle portion may be shaped such that it tapers as it extends towards both the parting portion and the applying portion.

The applying portion may also include a generally convexly extending blade. The applying portion may optionally include teeth that form a "rake" beneath or along the applying blade. The applying portion may also include a proximal portion and a distal portion, wherein the distal portion includes a substantially flat ridge for applying a substance to hair.

DETAILED DESCRIPTION OF THE INVENTION

Figure 1:
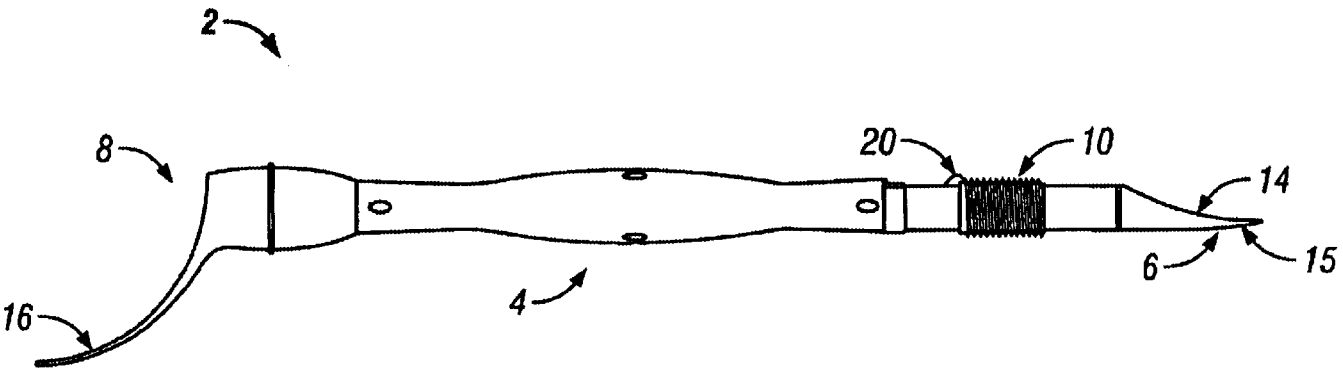
FIG. 1 presents a side view of a hair separator and fluid applicator according to a particular embodiment of the present invention, and includes a separate bottom view of an applicator.

A hair separator and fluid applicator is provided that can both part the hair and apply a substance such as relaxer to the hair. The hair separator and fluid applicator 2 shown in FIG. 1 includes a handle portion 4, a parting portion 6, and an applying portion 8. The hair separator and fluid applicator 2 also includes a ribbed ringlet comb 10, that may be moved in a groove 12 between the handle portion 4 and the parting portion 6 (as shown in more detail in FIG. 2). If used with a groove structure 12, the ribbed ringlet comb 10 may be configured with a tab 20 that can form a snap-fit relationship to hold it in place at either end of the groove 12.

The parting portion 6 may include a concave surface 14. The applying portion may include a generally convexly extending blade 16, as shown in FIGS. 1–3*a*. The handle portion 4 may taper as it extends toward the parting portion 6 and applying portion 8. This taper may permit a user to more comfortably and easily grip the separator and applicator.

Use of the hair separator and fluid applicator generally involves two functions: separating sections of the hair and applying a substance, such as relaxer, to the hair.

Figure 2:
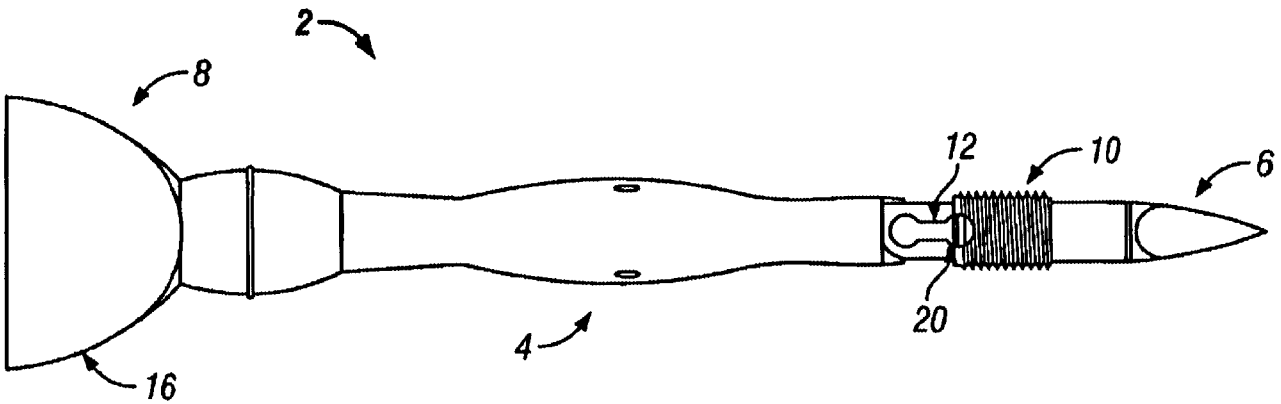
FIG. 2 presents a bottom view of a hair separator and fluid applicator according to a particular embodiment of the present invention.

During use, this concave surface 14 of the parting portion 6 generally conforms to the shape of the human head when it is used to press or conform the hair against the scalp. Nonetheless, while performing a parting function, the undersurface 15 (opposite the concave surface 14) is generally placed closer to the scalp to achieve an effective part. As shown in FIG. 2, the parting portion 6 may narrow as it extends away from the handle portion. This narrowing assists the user to separate the hair, as it can be used to very specifically select the portion where a part is desired and, when pressed through the hair, forces the hair apart.

Once the hair is separated, for example into two sections, the concave underside 14 of the parting portion 6 may be used to press the hair against the scalp. Due to the generally curved shape of the human head, the concave face 14 generally conforms to the shape of the human head, unlike the flat surface typically associated with a standard rat-tail comb currently used. The pressing of the parted hair against the head is beneficial because it permits the person applying fluid to the hair to have a manageable piece of hair to apply the fluid, and to apply and smoothly press the fluid more evenly, thereby providing a straightening effect to the hair strands after the hair has become softened by the use of chemical straighteners (i.e., relaxers).

The various portions of the applicator and separator can be separate pieces or formed together as one integral unit. The parting portion 6 may be formed as an attachment, with multiple tips having varying lengths based on, for example, user preference. The applying portion 8 may also be formed as a replaceable attachment, thus enabling the user to place different blades, rolling devices, brushes, standard rat tails, or crochet-type needle (e.g., of a type used with a frosting cap, when used when adding highlights or lowlights for short hair) onto the separator and applicator. The attachment may be attachable and detachable by a friction fit, snap fit, moveable button fit, or other appropriate means.

Figure 5:
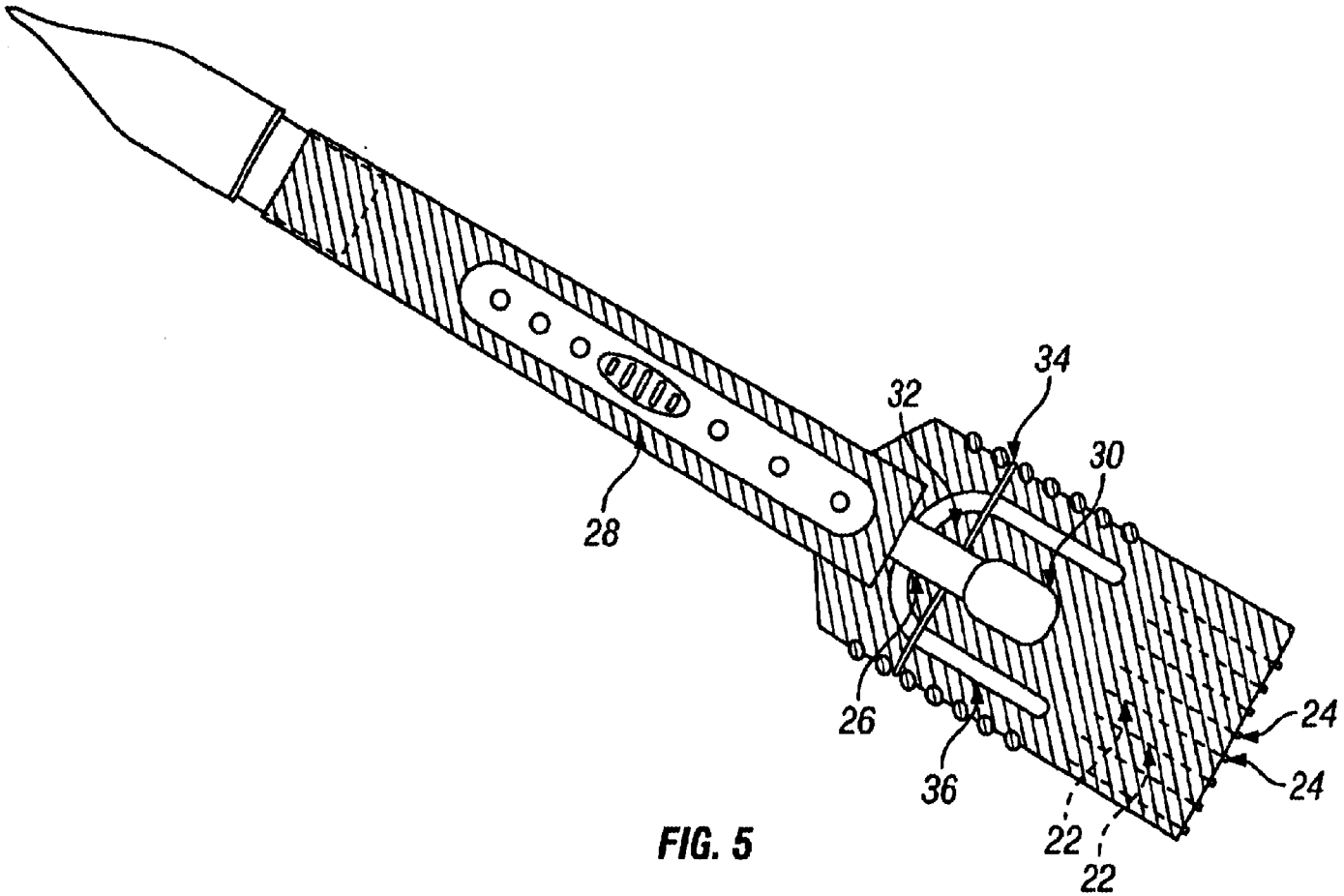
FIG. 5 presents a bottom view of a hair separator and fluid applicator according to an alternative embodiment of the invention.
Figure 6:
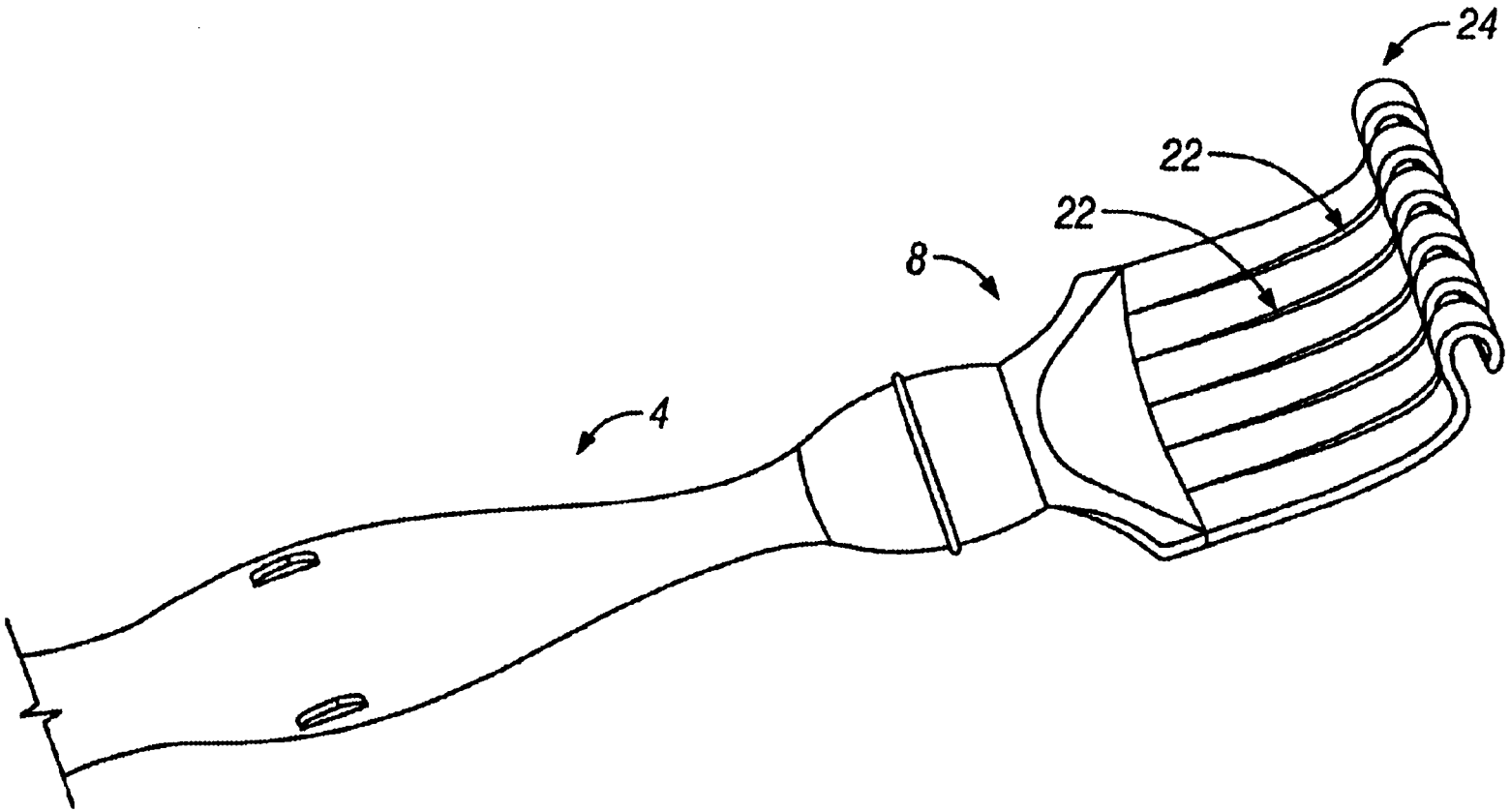
FIG. 6 presents a partial bottom view of a hair separator and fluid applicator according to an alternative embodiment of the invention.
Figure 6A:
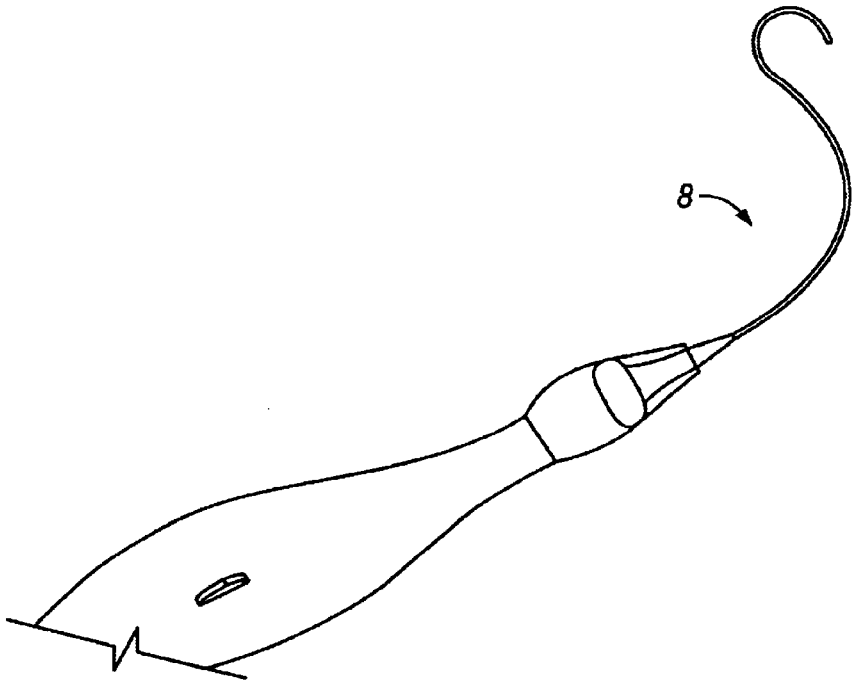
FIGS. 6*a*–6*c* present diagrammatic views of a blade according to a particular embodiment of the invention.
Figure 6B:
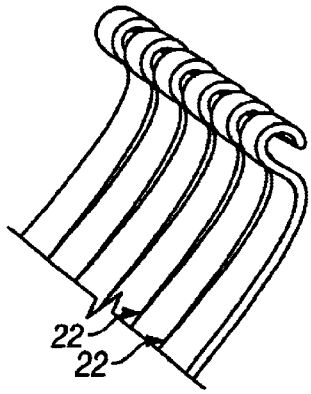
Figure 6C:
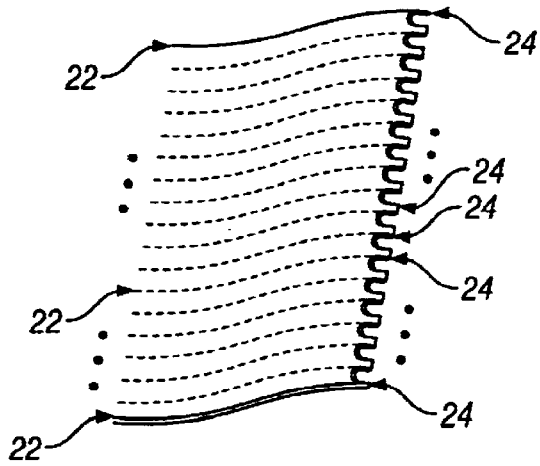

In an alternative embodiment of the invention in which the applying portion 8 includes a blade 16 having grooves or ridges 22 along the surface of the blade, as illustrated in FIGS. 5 and 6–6*c*. At the end of the blade 16, the ridges 22 preferably form teeth 24 along the end portion. In a further alternative embodiment, the teeth 24 may be provided along the end portion, but no ridges 22 are provided. The ridges 22 (and associated grooves) and teeth 24 permit the user to direct the hair along the path of the ridges 22, grooves or teeth 24. In this way, one can direct linear strands of hair to keep them separated, prevent hair tangling and manipulate in a desired manner (such as, for example, swirls or other shapes on a surface of the head).

Figure 7:
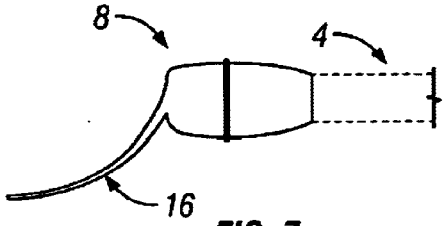
FIG. 7 presents a diagrammatic view of a blade according to a particular embodiment of the invention.

In another embodiment, the blade 16 is curved along its entire length, as shown in FIG. 7, so that the proximal and distal ends are both along an axis extending along the handle portion 4. The continuous curvature creates a more flexible blade, thereby enabling varying pressures to be applied to the hair. The ability to use varying pressures is useful because different pressures are desired for different types and textures of hair, when utilizing the blade. For example, extra curly strong hair having a large diameter (for example, ovalflat celled hair such as is often present in the hair of people of Jewish descent) needs more pressure to be properly relaxed than fine kinky flat-celled hair (such as, for example, is often present in the hair of African Americans).

The blade 16 and the concave tip 6 are preferably transparent or translucent in color, The translucency or transparency of the hair blade 16 and the concave tip 6 permits the user to view the hair while applying fluid to the hair (such as relaxer) for more precise application. This permits the user to avoid overlapping previously chemically treated hair, as, for example when using relaxer, where the relaxer permanent straightening fluid should be applied only to new hair growth. When applied to previously treated hair, the relaxer can cause extensive damage to the hair, such as, for example, total breakage of the hair shaft or increasing the rigidity of the hair.

In yet another alternative embodiment, the applying blade 16 can be made to have varying curvature or rigidity. Varying the rigidity and/or curvature of the blade is useful, for example, because different users of the device may desire differing stiffnesses and curvatures for applying fluids to the hair and creating blade radii to apply fluids in a manner that conforms to the head shape. Additionally, a user of the device may desire differing stiffnesses and curvatures for applying different substances to the hair. The varying rigidity may be accomplished, for example, by the use of a telescoping brace 26 (nicknamed a "durometer"), shown in FIG. 5. The brace 26 may be moveable, for example, through the use of a press-and-lock button system 28 shown in FIG. 5, or through other suitable means. When the distal tip 30 of the brace is moved further away from the handle portion 4, the brace presses up against the blade 16 and makes the blade more rigid. When the distal tip of the brace 30 is withdrawn, the blade 16 becomes less rigid.

The rigidity may also (or alternatively) be varied, for example, through the use of a tongue (or tab) 32 and a ringlet 34 configured to slide along the blade. When free to move (i.e., not restricted by the ringlet 34), the creation of the tongue 32 causes the blade to be generally less rigid than if a solid blade were used. The tongue 32 may be created by creating a void 36 (for example a U-shaped void as shown in FIG. 5) in the blade 16. When moved along the length of the tongue 32 from the attached portion to the detached portion, the ringlet 34 causes the blade 16 to be stiffer. The change in stiffness is due to the pivot about which the blade flexes 34—i.e., it will flex about the location of the ringlet 34. The ringlet 34 can also be used to vary the radius of the blade 16 when the ringlet is disposed on one side of the tongue. For example, when the entire ringlet 34 is placed on the outside (with respect to the concave surface of the blade), the tongue 32 is forced away from the ringlet 34 and the curvature of the blade 16 decreases. When both sides of the ringlet 34 are placed on the inside of the tongue, the tongue 34 is forced away from the ringlet 34, causing an increase in the curvature of the blade 16.

Figure 3:
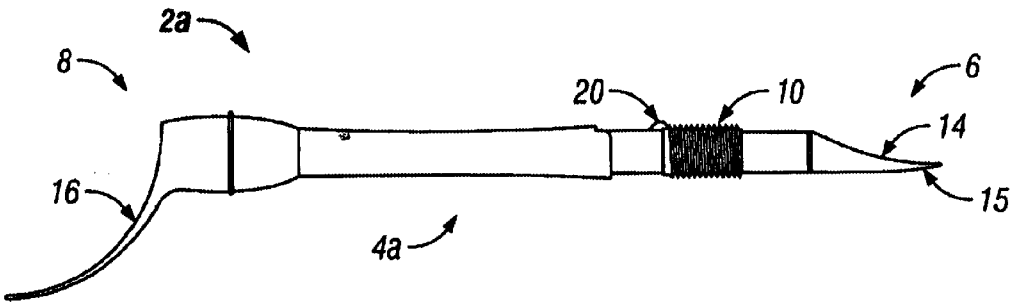
FIGS. 3 and 3*a* present a side view of a hair separator and fluid applicator, and a bottom view of a blade, according to a particular embodiment of the present invention.
Figure 4A:
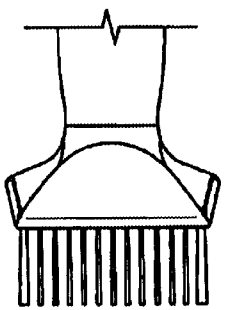
FIGS. 4*a* and 4*b* present views of alternative applicator portions according to additional embodiments of the present invention.
Figure 4:
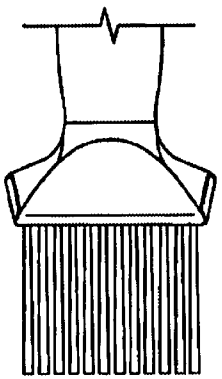
Figure 3A:
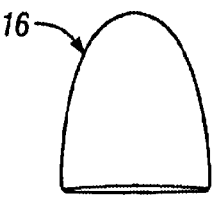
Figure 8:
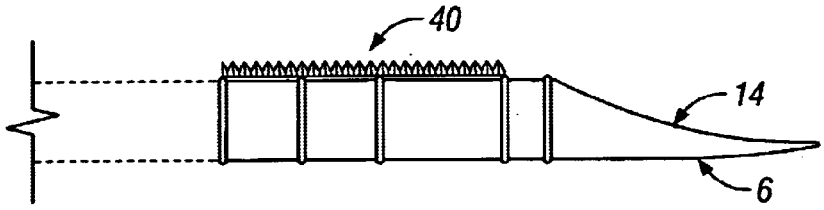
FIGS. 8 and 8*a* present diagrammatic side views of alternative embodiments of the invention.
Figure 8A:
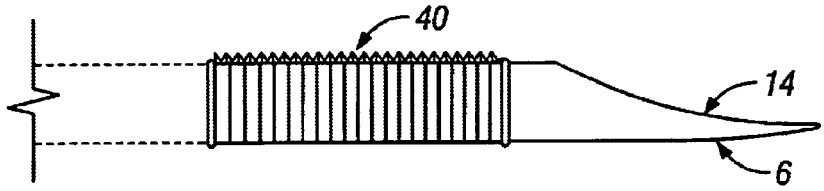
Figure 9:
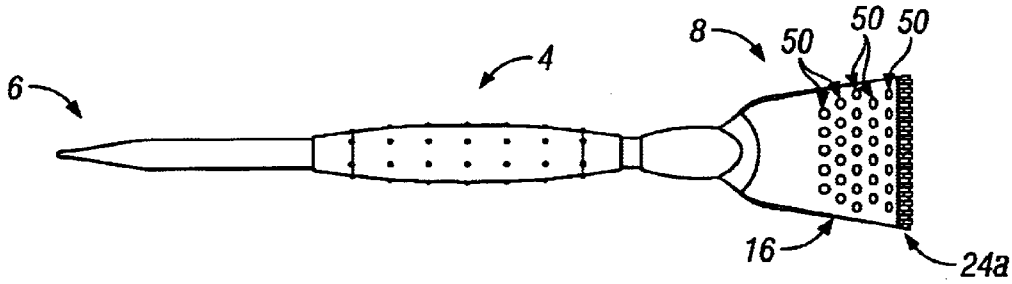
FIG. 9 presents a top view of a hair separator and fluid applicator according to an alternative embodiment of the present invention.
Figure 10:
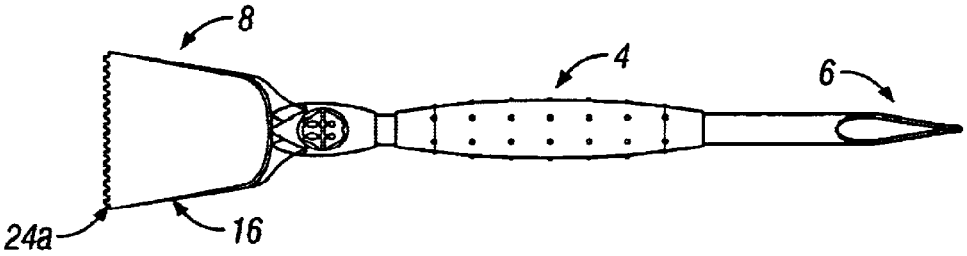
FIG. 10 presents a top view of a hair separator and fluid applicator according to an alternative embodiment of the present invention.
Figure 11:
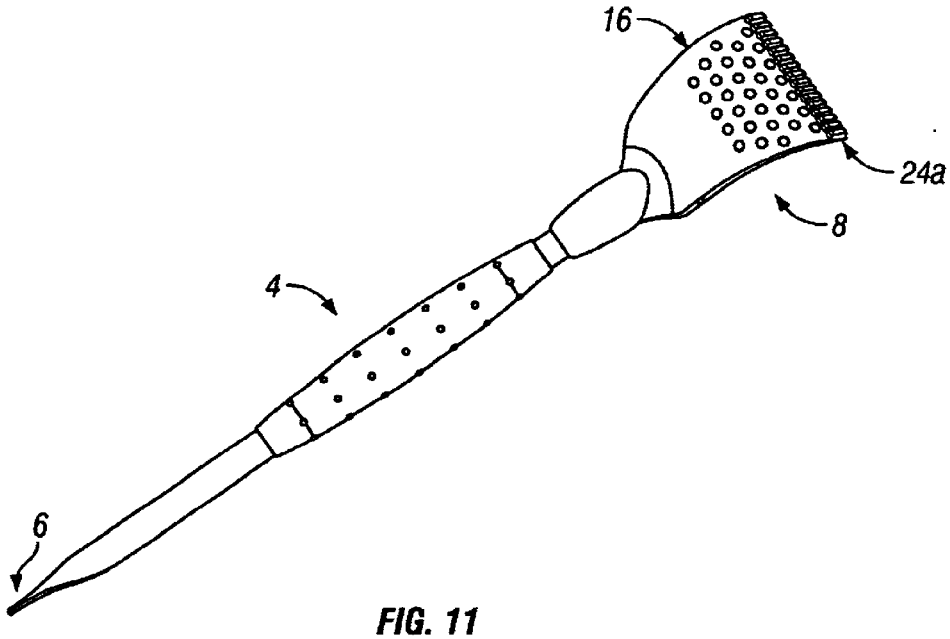
FIG. 11 presents a partial-top view of a hair separator and fluid applicator according to an alternative embodiment of the present invention.
Figure 12:
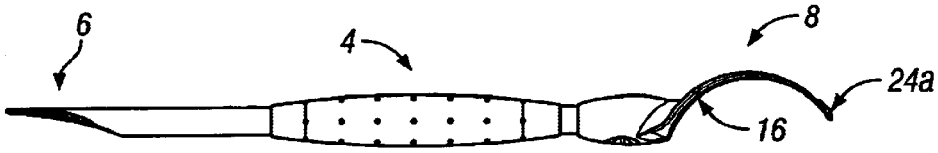
FIG. 12 presents a side view of a hair separator and fluid applicator according to an alternative embodiment of the present invention.

A comb 40 may be attached along the shaft of the separator and applicator as shown in FIG. 8, for example in a snap-fit or friction-fit relationship. The comb 40 may include teeth on one side only, or may include teeth on one side and a ribbed ringlet comb on the other, as illustrated in FIG. 8*a* and/or a continuous 360° ribbed ringlet comb. If the ribbed ringlet comb 10 is used without a separate comb with teeth (as illustrated in FIGS. 1–3), the ringlet comb 10 may be detachable through use of a friction fit or pressure fit, such as, for example, the ringlet comb extending over a nub extending radially from the separator and applicator. In any case, a continuous ribbed ringlet comb 10 may become attached and/or detailed by use of a friction or pressure fit.

As discussed briefly above, the applying portion 8 may optionally include continuous teeth that form ridges 22 beneath or along the applying blade, as illustrated in FIGS. 5, 6, 6*b*, and 6*c*. The teeth in the blade may form evenly spaced ridges 22 along and across a distance of or the entirety of the applying blade 16. The teeth, or ridges 22, can be used to directionally smooth or detangle hair. The distal end of the blade may also be curled, preferably in the opposite direction of the curvature of the blade, thereby forming a "rake," as illustrated in FIGS. 6, 6*a* and 6*b*. When curled and having ridges 22, the blade 16 is optimized as a ma, directional hair smoother and detangler, especially when used with long or medium length hair, or thick-stranded hair. People with this type of hair generally include those with overly curly hair, African-Americans, Jewish, Middle Easterners, Italians, and Eastern Europeans. Specifically, the curled nature of the rake permits the blade to contact the hair in two separate places, establishing a comb effect separate from the main portion of the blade. The continuous teeth or ridges 22 are preferably dull, such as not to place sharp edges against the skin, thereby avoiding potential skin abrasions. In one contemplated embodiment, the blade is approximately 2.5 inches in width, 2 inches in length, the ridges have a height of 1/16 inch, and the ridges are separated by 1/16 inch.

FIGS. 9–13*b* illustrate yet another alternative embodiment of the invention. In this embodiment, the blade 16 further includes dimples 50 on the convex surface. These dimples may assist the user in applying a fluid to the hair as it increases the friction, thus resulting in fluids or cremes having lower surface tensions being able to be retained on the surface of the blade. The staggered arrangement of the dimples 50, as illustrated, is thought to further increase the friction, and thus allow a fluid having still further lower viscosity or surface tension to remain attached to the blade 16 to be retained long enough for application to the hair.

In still a further embodiment illustrated in FIG. 15, rather than dimples 50, holes 54 are punched all the way through the blade 16. - This is thought to still further increase the ability of the blade 16 to retain an even less viscous or lower surface tension fluid to the blade 16. As with the dimples 50, the holes 54 are illustrated in a staggered relationship in an effort to maximize the blade's retention capability.

As illustrated in all of FIGS. 9–14, the blade 16 includes teeth 24*a* along substantially only the end portion of the blade 16. This teeth may be used to shape or sculpt the hair as a material is being applied. In between the teeth 24*a*, channels 25 are created, as illustrated in FIGS. 13*a* and 13*b*. The illustrated channels 25 are half-circular in shape, although this shape may be varied to desirably conform to the style of hair being treated (e.g., based on hair shape). For example, the channels may also be ovular or rectangular (including "square") in shape.

Figure 13A:
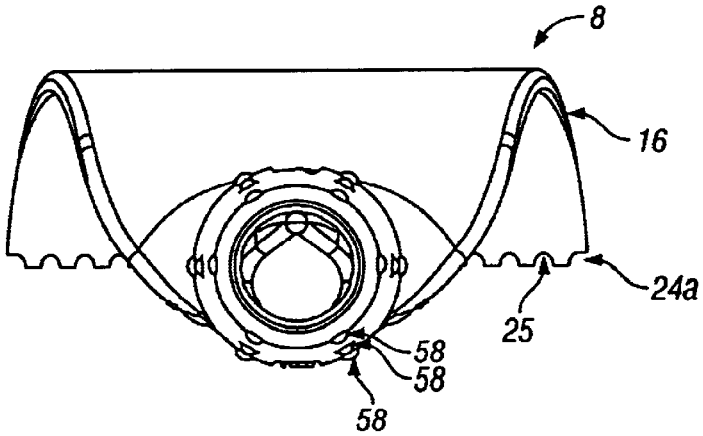
FIGS. 13*a* and 13*b* present views of an applying portion according to an additional embodiments of the present invention.
Figure 13B:
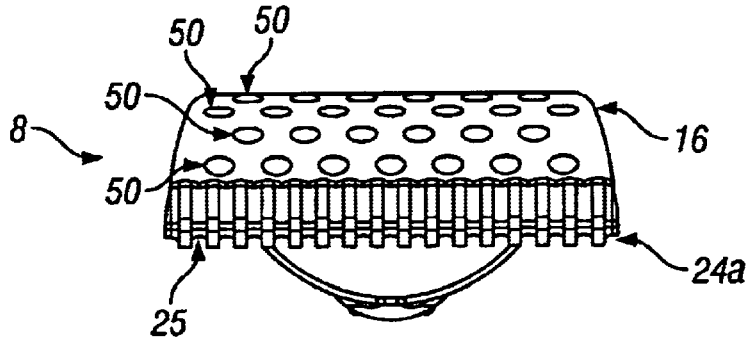
Figure 14:
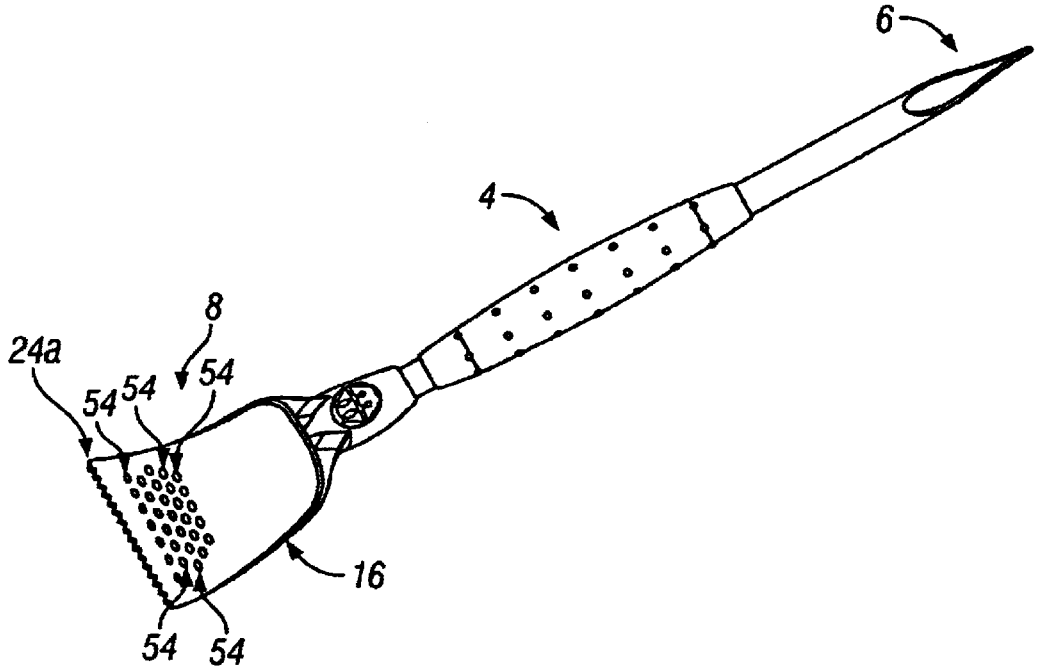
FIG. 14 presents a bottom view of a hair separator and fluid applicator according to yet another alternative embodiment of the present invention.

As illustrated in FIGS. 13*a* and 13*b*, the applying portion 8 may be detachable from the remainder of the hair separator and fluid applicator. Specifically, the applying portion 8 may be detached from the handle portion 4. The detachable applying portion may include nubs 58 for creating a snap fit with the handle portion 4, as illustrated in FIG. 13*a*. The detachable relationship may also be created by way of a friction fit.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. A hair separator and fluid applicator comprising:

a central handle portion;

a parting portion disposed adjacent said central handle portion; and an applying portion disposed adjacent said central handle portion opposite said parting portion, said applying portion including a generally convexly extending blade, a plurality of dimples disposed on a convex surface of said blade, a generally convexly extending blade, a proximal portion and a distal portion, said distal portion comprises a substantially flat edge for applying a substance to hair, and said applying portion further includes a plurality of stiff ridges extending along at least a portion of a face of said blade.

2. The separator and applicator of claim 1 wherein said applying portion including a plurality of teeth disposed along said flat edge.

3. The separator and applicator of claim 1 wherein said blade includes a distal end and a proximal end, said distal end disposed opposite said handle portion, and said plurality of teeth extending along at least a portion of said distal end of said blade.

4. The separator and applicator of claim 1 wherein said parting portion further including a generally concave face.

5. The separator and applicator of claim 1 wherein said parting portion includes a proximal end and a distal end, said distal end disposed opposite said central handle portion, said parting portion generally narrowing from the proximal end to the distal end.

6. The separator and applicator of claim 1 wherein said blade includes a proximal portion and a distal portion, wherein said distal portion comprises a substantially flat edge for applying a substance to hair.

7. The separator and applicator of claim 1 wherein said handle portion is disposed along a generally longitudinally extending axis, and is shaped such that it tapers as it extends towards both the parting portion and the applying portion.

8. The separator and applicator of claim 1 wherein said parting portion comprises an attachment to said handle portion.

9. The separator and applicator of claim 1 wherein said applying portion comprises an attachment to said handle portion.

10. The separator and applicator of claim 1 wherein said dimples are disposed in a staggered relationship on said convex surface of said blade.

11. A hair separator and fluid applicator comprising:

a central handle portion;

a parting portion disposed adjacent said central handle portion; and an applying portion disposed adjacent said central handle portion opposite said parting portion, said applying portion applying portion including a generally convexly extending blade and a plurality of apertures disposed on said blade, a proximal portion and a distal portion, said distal portion comprises a substantially flat edge for applying a substance to hair, and said applying portion further includes a plurality of stiff ridges extending along at least a portion of a face of said blade.

12. The separator and applicator of claim 11 wherein said apertures are disposed in a staggered relationship on said blade.

* * * * *